US005884889A

United States Patent [19]

Crosby

[11] Patent Number: 5,884,889

[45] Date of Patent: Mar. 23, 1999

[54] ADJUSTABLE BOOK SUPPORT WITH ARM CLEARANCE RECESSES

[76] Inventor: Tom Crosby, 13807 Ivymount, Sugarland, Tex. 77478

[21] Appl. No.: 886,369

[22] Filed: Jul. 1, 1997

[51] Int. Cl.[6] ..... A47B 97/08

[52] U.S. Cl. ..... 248/460; 248/444; 248/444.1; 248/459; 248/558

[58] Field of Search ..... 248/460, 462, 248/463, 464, 441.1, 444, 444.1, 445, 447, 451, 459, 558

[56] References Cited

U.S. PATENT DOCUMENTS

| | | | |
|---|---|---|---|
| 2,481,107 | 9/1949 | Gore | 248/444 |
| 2,627,694 | 2/1953 | Salcker | 45/82 |
| 2,784,929 | 3/1957 | Diening | 248/463 X |
| 3,690,620 | 9/1972 | Matson et al. | 248/459 X |
| 3,981,522 | 9/1976 | Bloom | 248/451 X |
| 4,060,216 | 11/1977 | Million | 248/460 |
| 4,205,817 | 6/1980 | Corder | 248/444.1 X |
| 4,465,255 | 8/1984 | Hill | 248/441.1 |
| 4,709,895 | 12/1987 | Mardak | 248/460 |
| 4,771,977 | 9/1988 | Larson | 248/460 |
| 5,165,648 | 11/1992 | Quigley | 248/444 X |
| 5,722,628 | 3/1998 | Menaged | 248/460 X |

*Primary Examiner*—Derek J. Berger
*Assistant Examiner*—Stephen S. Wentsler
*Attorney, Agent, or Firm*—Joseph N. Breaux

[57] ABSTRACT

A book support for supporting a book for a reader that includes an arm clearance panel including right and left arm clearance side edges each having a curved arm clearance recess; a book support panel constructed from a transparent material and including two book support ledges extending outwardly from a book support front surface and an elastic book retaining strap secured across the book support front surface; a base panel; a head clearance panel including a curved head clearance recess; a first hinge connected between a book support back surface of the book support panel and a top arm clearance side edge of the arm clearance panel; a second hinge connected between a top book support side edge of the book support panel and a top base side edge of the base panel; and a third hinge connected between the base back surface of the base panel and the top head clearance side edge of the head clearance panel.

20 Claims, 2 Drawing Sheets

ADJUSTABLE BOOK SUPPORT WITH ARM CLEARANCE RECESSES

TECHNICAL FIELD

The present invention relates to devices for supporting a book or other reading material for a reader and more particularly to an adjustable book support that includes an arm clearance panel including an arm clearance front surface, an arm clearance back surface, a top arm clearance panel side edge, a bottom arm clearance side edge, a left arm clearance side edge and a right arm clearance side edge, the right and left arm clearance side edges each including a curved arm clearance recess, the arm clearance back surface having two arm clearance hook and pile fastener sections secured thereto; a book support panel constructed from a transparent material and including a book support front surface, a book support back surface, a top book support panel side edge, a bottom book support side edge, a left book support side edge and a right book support side edge, the book support front surface having two book support ledges extending outwardly therefrom, the book support bottom side edge having thumb notch formed therein, the book support panel including an elastic book retaining strap secured across the book support front surface; a base panel including a base front surface, a base back surface, a top base panel side edge, a bottom base side edge, a left base side edge and a right base side edge; a head clearance panel including an head clearance front surface, a head clearance back surface, a top head clearance panel side edge, a bottom head clearance side edge, a left head clearance side edge and a right head clearance side edge, the head clearance bottom edge including a curved head clearance recess, the head clearance front surface having two head clearance hook and pile fastener sections secured thereto; a first hinge connected between the book support back surface of the book support panel and the top arm clearance side edge of the arm clearance panel; a second hinge connected between the top book support side edge of the book support panel and the top base side edge of the base panel; and a third hinge connected between the base back surface of the base panel and the top head clearance side edge of the head clearance panel.

BACKGROUND OF THE INVENTION

Many individuals, because of comfort or infirmity, use a book support when reading to provide hands free support for a book or other reading material. Although book supports are known, it would be desirable to have an adjustable book support that can be configured in an A-frame configuration for supporting a book on a table or an L-shaped configuration for supporting a book in a front a reader seated in a chair.

SUMMARY OF THE INVENTION

It is thus an object of the invention to provide an adjustable book support that is configurable in an A-frame configuration for supporting a book on a table.

It is a further object of the invention to provide an adjustable book support that is configurable in an L-shaped configuration for supporting a book in front of a reader seated in a chair.

It is a still further object of the invention to provide an adjustable book support that includes an arm clearance panel including an arm clearance front surface, an arm clearance back surface, a top arm clearance panel side edge, a bottom arm clearance side edge, a left arm clearance side edge and a right arm clearance side edge, the right and left arm clearance side edges each including a curved arm clearance recess, the arm clearance back surface having two arm clearance hook and pile fastener sections secured thereto; a book support panel constructed from a transparent material and including a book support front surface, a book support back surface, a top book support panel side edge, a bottom book support side edge, a left book support side edge and a right book support side edge, the book support front surface having two book support ledges extending outwardly therefrom, the book support bottom side edge having thumb notch formed therein, the book support panel including an elastic book retaining strap secured across the book support front surface; a base panel including a base front surface, a base back surface, a top base panel side edge, a bottom base side edge, a left base side edge and a right base side edge; a head clearance panel including an head clearance front surface, a head clearance back surface, a top head clearance panel side edge, a bottom head clearance side edge, a left head clearance side edge and a right head clearance side edge, the head clearance bottom edge including a curved head clearance recess, the head clearance front surface having two head clearance hook and pile fastener sections secured thereto; a first hinge connected between the book support back surface of the book support panel and the top arm clearance side edge of the arm clearance panel; a second hinge connected between the top book support side edge of the book support panel and the top base side edge of the base panel; and a third hinge connected between the base back surface of the base panel and the top head clearance side edge of the head clearance panel.

It is a still further object of the invention to provide an adjustable book support that accomplishes some or all of the above objects in combination.

Accordingly, an adjustable book support is provided that includes an arm clearance panel including an arm clearance front surface, an arm clearance back surface, a top arm clearance panel side edge, a bottom arm clearance side edge, a left arm clearance side edge and a right arm clearance side edge, the right and left arm clearance side edges each including a curved arm clearance recess, the arm clearance back surface having two arm clearance hook and pile fastener sections secured thereto; a book support panel constructed from a transparent material and including a book support front surface, a book support back surface, a top book support panel side edge, a bottom book support side edge, a left book support side edge and a right book support side edge, the book support front surface having two book support ledges extending outwardly therefrom, the book support bottom side edge having thumb notch formed therein, the book support panel including an elastic book retaining strap secured across the book support front surface; a base panel including a base front surface, a base back surface, a top base panel side edge, a bottom base side edge, a left base side edge and a right base side edge; a head clearance panel including an head clearance front surface, a head clearance back surface, a top head clearance panel side edge, a bottom head clearance side edge, a left head clearance side edge and a right head clearance side edge, the head clearance bottom edge including a curved head clearance recess, the head clearance front surface having two head clearance hook and pile fastener sections secured thereto; a first hinge connected between the book support back surface of the book support panel and the top arm clearance side edge of the arm clearance panel; a second hinge connected between the top book support side edge of the book support panel and the top base side edge of the base panel; and a third hinge connected between the base back surface of the base panel and the top head clearance side edge of the head clearance panel.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

DESCRIPTION OF THE EXEMPLARY EMBODIMENT

Figure 1:
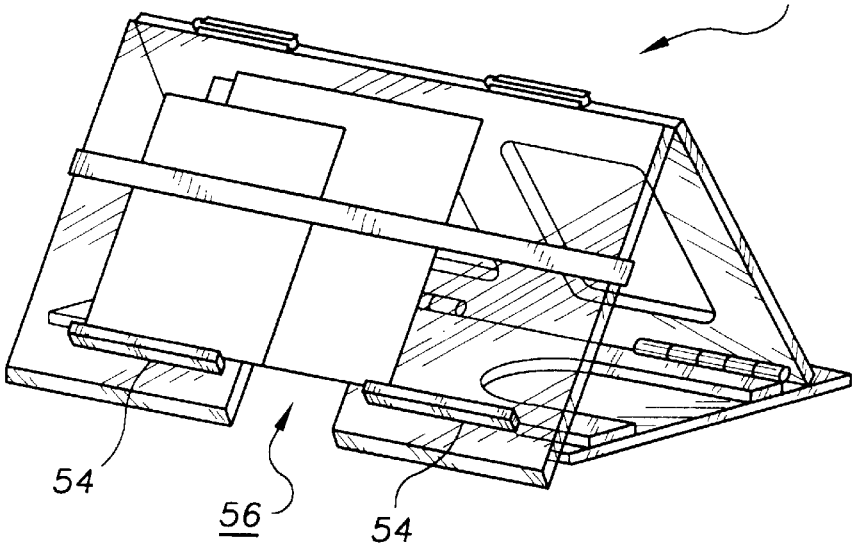
FIG. 1 is a perspective view of an exemplary embodiment of the adjustable book support of the present invention in the A-frame configuration and showing the book support panel, the base panel, the arm clearance panel, the head clearance panel.
Figure 1A:
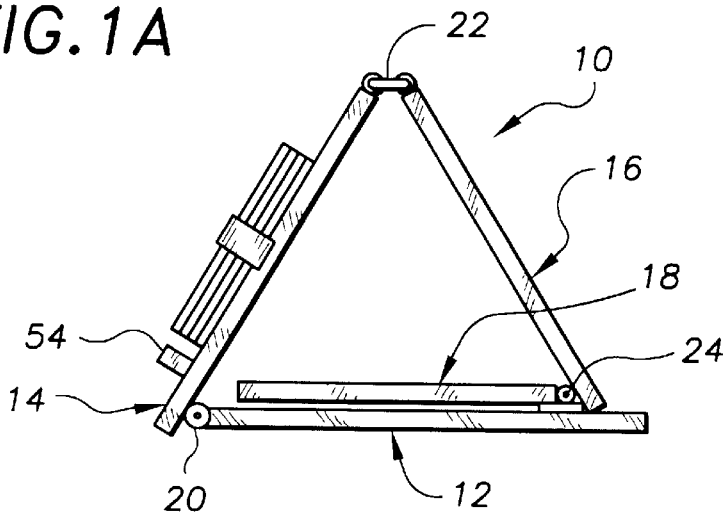
FIG. 1A is a side plan view of the exemplary adjustable book support of FIG. 1 folded in the A-frame configuration and showing the first hinge connected between the book support panel and the arm clearance panel; the second hinge connected between the book support panel and the base panel; and the third hinge connected between the base panel and the head clearance panel.

FIG. 1 shows an exemplary embodiment of the adjustable book support of the present invention, generally designated by the numeral 10, in the A-frame configuration. With reference to FIG. 1A, in this embodiment, adjustable book support 10 includes an arm clearance panel, generally designated 12; a book support panel, generally designated 14; a base panel, generally designated 16, a head clearance panel, generally designated 18; a first hinge 20, a second hinge 22; and a third hinge 24. Arm clearance panel 12, book support panel 14, base panel 16, and head clearance panel 18 are each constructed from transparent polycarbonate plastic.

Figure 2:
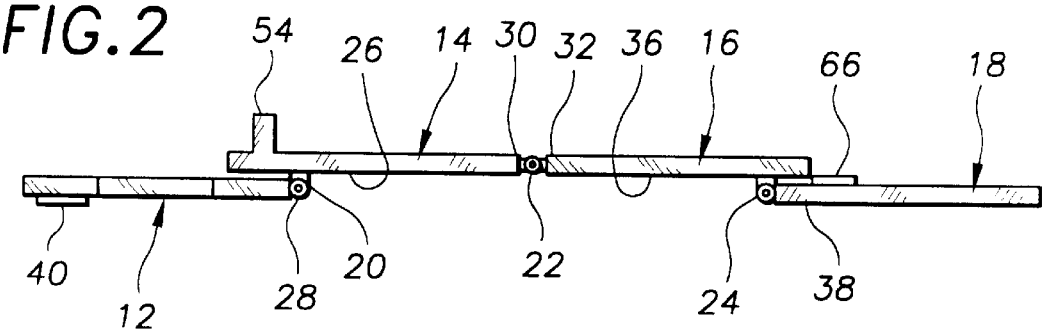
FIG. 2 is a side plan view of the exemplary adjustable book support of FIG. 1 unfolded and showing the first hinge connected between the back surface of the book support panel and the edge of the arm clearance panel; the second hinge connected between the top edge of the book support panel and the top edge of the base panel; the third hinge connected between the back surface of the base panel and the edge of the head clearance panel; one of the two book support ledges extending outwardly from the front surface of the book support panel; one of the two arm clearance hook and pile fastener sections secured to the back surface of the arm clearance panel; and one of the two head clearance hook and pile fastener sections secured to the front surface of the head clearance panel.

With reference to FIG. 2, first hinge 20 is secured between a back surface 26 of book support panel 14 and a top side edge 28 of arm clearance panel 12. Second hinge 22 is connected between a top edge 30 of book support panel 14 and a top edge 32 of base panel 16. Third hinge 24 is connected between a back surface 36 of base panel 16 and a top edge 38 of head clearance panel 18.

Figure 3:
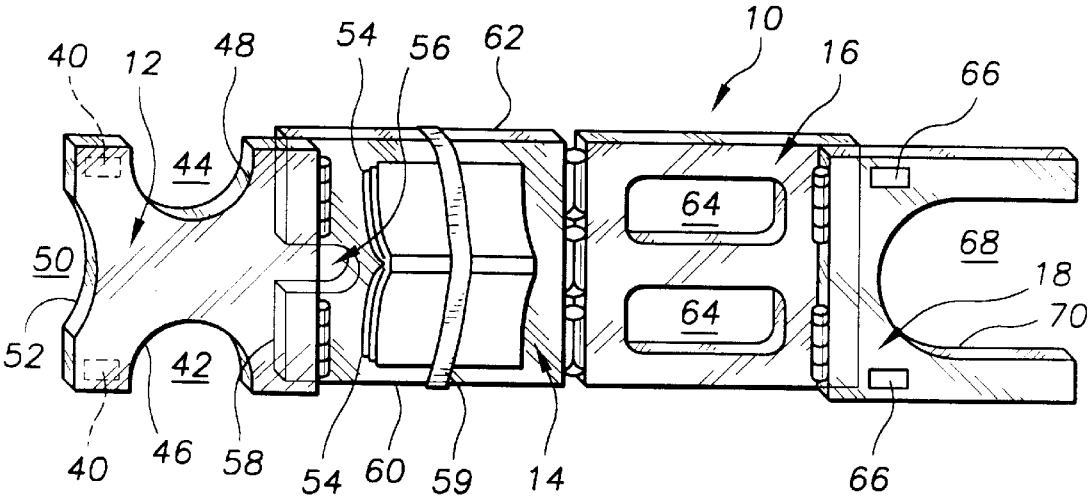
FIG. 3 is a top plan view of the exemplary adjustable book support of FIG. 1 unfolded and showing the two arm clearance hook and pile fastener sections secured to the back surface of the arm clearance panel, the two arm clearance recesses formed into the side edges of the arm clearance panel, and the lap recess formed into the bottom edge of the arm clearance panel; the two book support ledges extending outwardly from the front surface of the book support panel, the thumb notch formed into the bottom edge of the book support panel, and the clear elastic book retaining strap secured across the front surface of the book support panel; the two weight reduction holes formed through the base panel; and the two head clearance hook and pile fastener sections secured to the front surface of the head clearance panel and the head clearance recess formed into the bottom edge of the head clearance panel.

With reference to FIG. 3, arm clearance panel 12 includes two arm clearance hook and pile fastener sections 40 (one shown in FIG. 2) secured to a back surface of arm clearance panel 12; two arm semi-circular clearance recesses 42,44 formed into side edges 46,48 respectively of arm clearance panel 12; and a lap recess 50 formed into a bottom edge 52 of arm clearance panel 12. Book support panel 14 includes two integrally formed book support ledges 54 (also shown in FIGS. 1, 1A and 2) extending outwardly from the front surface of book support panel 14; a thumb notch 56 (also shown in FIG. 1) formed into a bottom edge 58 of book support panel 14 and positioned between book support ledges 54; and a clear elastic book retaining strap 59 secured across the front surface of and to the side edges 60,62 of book support panel 14.

Base panel 16 includes two weight reduction holes 64 to reduce the weight of adjustable book support 10. Head clearance panel 18 includes two head clearance hook and pile fastener sections 66 secured to the front surface of head clearance panel 18 and a U-shaped head clearance recess 68 formed into a bottom edge 70 of head clearance panel 18.

Figure 4:
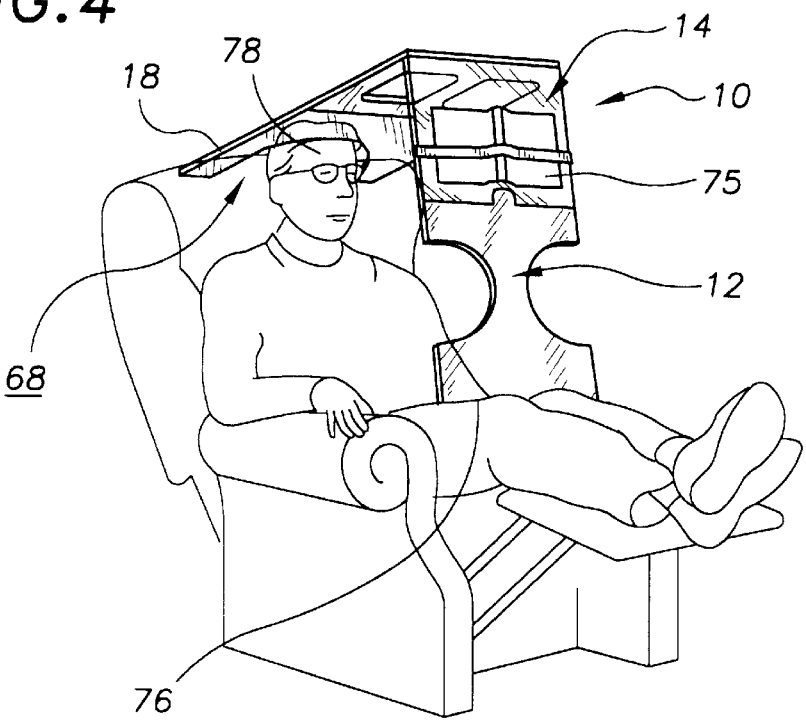
FIG. 4 is a perspective view of the exemplary adjustable book support of FIG. 1 configured in the L-shaped configuration and positioned over a reader seated in a representative chair.

In use, adjustable book support 10 can be secured in the A-frame configuration shown in FIGS. 1 and 1A by securing the two arm clearance hook and pile fastener sections 40 to the two head clearance hook and pile fastener sections 66. With reference to FIG. 4, when a user is seated in a chair, adjustable book support 10 can be used by placing the printed text of a book 75 or other reading material against the front surface of book support panel 14 so that the text is read through the clear plastic material. Lap recess 50 (FIG. 3) of arm clearance panel 12 is then placed onto the user's lap 76 while the user's head 78 is placed into head clearance recess 68 of had clearance panel 18.

It can be seen from the preceding description that an adjustable book support has been provided that is configurable in an A-frame configuration for supporting a book on a table; that is configurable in an L-shaped configuration for supporting a book in a front a reader seated in a chair; and that includes an arm clearance panel including an arm clearance front surface, an arm clearance back surface, a top arm clearance panel side edge, a bottom arm clearance side edge, a left arm clearance side edge and a right arm clearance side edge, the right and left arm clearance side edges each including a curved arm clearance recess, the arm clearance back surface having two arm clearance hook and pile fastener sections secured thereto; a book support panel constructed from a transparent material and including a book support front surface, a book support back surface, a top book support panel side edge, a bottom book support side edge, a left book support side edge and a right book support side edge, the book support front surface having two book support ledges extending outwardly therefrom, the book support bottom side edge having thumb notch formed therein, the book support panel including an elastic book retaining strap secured across the book support front surface; a base panel including a base front surface, a base back surface, a top base panel side edge, a bottom base side edge, a left base side edge and a right base side edge; a head clearance panel including an head clearance front surface, a head clearance back surface, a top head clearance panel side edge, a bottom head clearance side edge, a left head clearance side edge and a right head clearance side edge, the head clearance bottom edge including a curved head clearance recess, the head clearance front surface having two head clearance hook and pile fastener sections secured thereto; a first hinge connected between the book support back surface of the book support panel and the top arm clearance side edge of the arm clearance panel; a second hinge connected between the top book support side edge of the book support panel and the top base side edge of the base panel; and a third hinge connected between the base back surface of the base panel and the top head clearance side edge of the head clearance panel.

It is noted that the embodiment of the adjustable book support described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An adjustable book support comprising:

an arm clearance panel including an arm clearance front surface, an arm clearance back surface, a top arm clearance panel side edge, a bottom arm clearance side edge, a left arm clearance side edge and a right arm clearance side edge, said right and left arm clearance side edges each including a curved arm clearance recess, said arm clearance back surface having two arm clearance hook and pile fastener sections secured thereto;

a book support panel constructed from a transparent material and including a book support front surface, a book support back surface, a top book support panel side edge, a bottom book support side edge, a left book support side edge and a right book support side edge, said book support front surface having two book support ledges extending outwardly therefrom, said book support panel including an elastic book retaining strap secured across said book support front surface;

a base panel including a base front surface, a base back surface, a top base panel side edge, a bottom base side edge, a left base side edge and a right base side edge;

a head clearance panel including an head clearance front surface, a head clearance back surface, a top head clearance panel side edge, a bottom head clearance side edge, a left head clearance side edge and a right head clearance side edge, said bottom head clearance side edge including a curved head clearance recess, said head clearance front surface having two head clearance hook and pile fastener sections secured thereto;

a first hinge connected between said book support back surface of said book support panel and said top arm clearance side edge of said arm clearance panel;

a second hinge connected between said top book support side edge of said book support panel and said top base side edge of said base panel; and a third hinge connected between said base back surface of said base panel and said top head clearance side edge of said head clearance panel.

2. The adjustable book support of claim 1 wherein:

said bottom book support side edge has a thumb notch formed therein.

3. The adjustable book support of claim 2 wherein:

said elastic book retaining strap including a transparent section positionable over and across said book support front surface.

4. The adjustable book support of claim 3, wherein:

said arm clearance panel is constructed from a transparent plastic;

said base panel is constructed from a clear plastic; and said head clearance panel is constructed from transparent plastic.

5. The adjustable book support of claim 4 wherein:

said base panel has at least one weight reduction hole formed therethrough.

6. The adjustable book support of claim 3 wherein:

said base panel has at least one weight reduction hole formed therethrough.

7. The adjustable book support of claim 2, wherein:

said arm clearance panel is constructed from a transparent plastic;

said base panel is constructed from a clear plastic; and said head clearance panel is constructed from transparent plastic.

8. The adjustable book support of claim 7 wherein:

said base panel has at least one weight reduction hole formed therethrough.

9. The adjustable book support of claim 2 wherein:

said base panel has at least one weight reduction hole formed therethrough.

10. The adjustable book support of claim 1 wherein:

said elastic book retaining strap including a transparent section positionable over and across said book support front surface.

11. The adjustable book support of claim 10 wherein:

said base panel has at least one weight reduction hole formed therethrough.

12. The adjustable book support of claim 1, wherein:

said arm clearance panel is constructed from a transparent plastic.

13. The adjustable book support of claim 12 wherein:

said base panel has at least one weight reduction hole formed therethrough.

14. The adjustable book support of claim 1, wherein:

said base panel is constructed from a clear plastic.

15. The adjustable book support of claim 14 wherein:

said base panel has at least one weight reduction hole formed therethrough.

16. The adjustable book support of claim 1 wherein:

said head clearance panel is constructed from transparent plastic.

17. The adjustable book support of claim 16 wherein:

said base panel has at least one weight reduction hole formed therethrough.

18. The adjustable book support of claim 1, wherein:

said arm clearance panel is constructed from a transparent plastic;

said base panel is constructed from a clear plastic; and said head clearance panel is constructed from transparent plastic.

19. The adjustable book support of claim 18 wherein:

said base panel has at least one weight reduction hole formed therethrough.

20. The adjustable book support of claim 1 wherein:

said base panel has at least one weight reduction hole formed therethrough.

* * * * *